US005197730A

United States Patent [19]

Ask

[11] Patent Number: 5,197,730

[45] Date of Patent: Mar. 30, 1993

[54] MULTI-USE SWING APPARATUS

[76] Inventor: J. Fredrik Ask, 600 Raleigh Rd., Glenview, Ill. 60025

[21] Appl. No.: 577,339

[22] Filed: Jul. 25, 1990

[51] Int. Cl.[5] ..... A63G 9/00

[52] U.S. Cl. ..... 472/118; 248/341

[58] Field of Search ..... 272/85-92; 297/242-245, 277; 248/340, 341

[56] References Cited

U.S. PATENT DOCUMENTS

| | | | |
|---|---|---|---|
| 2,100,002 | 11/1937 | Evans et al. | 272/85 |
| 2,545,295 | 3/1951 | Miller | 272/85 |
| 3,829,086 | 8/1974 | Lelong | 272/85 |
| 3,937,463 | 2/1976 | Soisson | 272/85 |
| 4,046,375 | 9/1977 | Lelong | 272/85 |
| 4,116,433 | 9/1978 | Koerner | 272/85 |

FOREIGN PATENT DOCUMENTS

| | | | |
|---|---|---|---|
| 440339 | 7/1912 | France | 272/85 |

*Primary Examiner*—Richard E. Chilcot, Jr.

[57] ABSTRACT

A swing apparatus that can be used in many different configurations includes a "seat" portion for supporting a child or other user for swinging travel in a selective variety of paths. The swing includes a frame which supports the seat by one or more flexible or rigid support links for movement in a plurality of paths. The links can be selectively connected to a number of different suspension points on the frame and, similarly, on a number of different connection points on the seat to provide many different configuration or uses to provide multiple paths of travel for the seat.

21 Claims, 1 Drawing Sheet

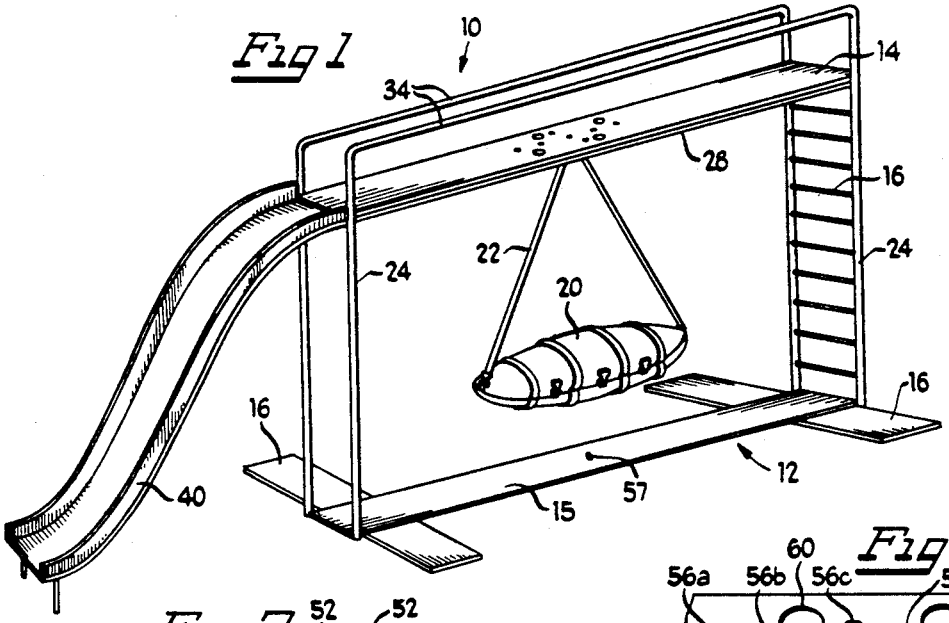
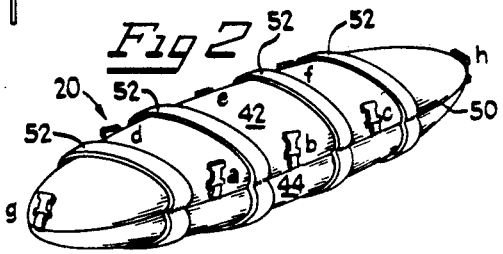
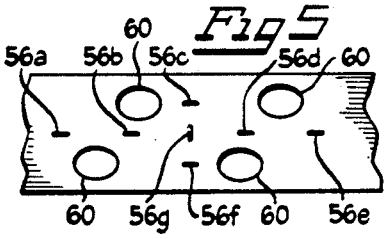
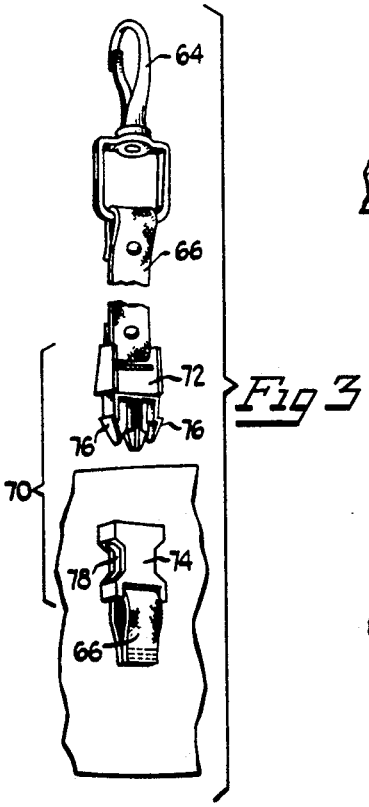
Fig 3
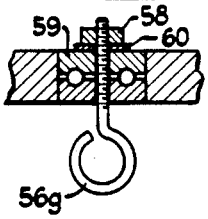
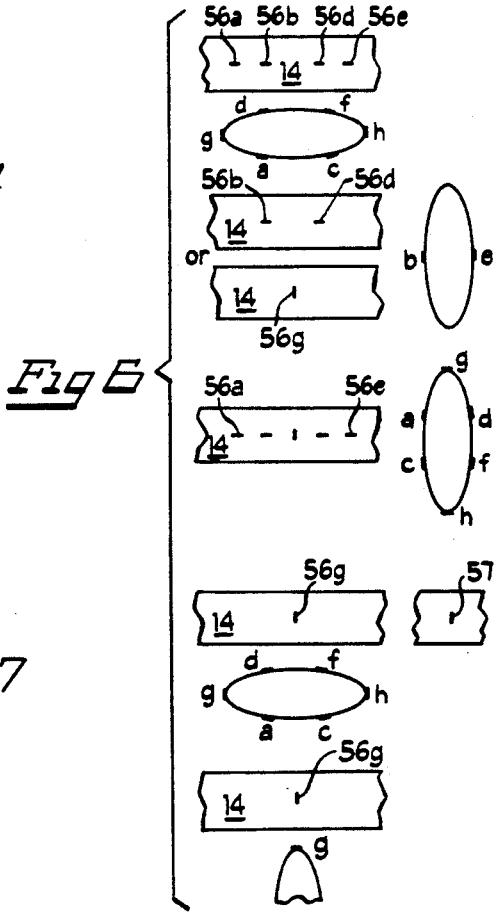
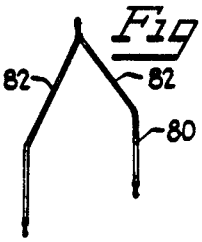

MULTI-USE SWING APPARATUS

BACKGROUND OF THE INVENTION

1. Field of the Invention

This invention relates generally to a child's riding device for one or more children, and more particularly to a multi-use swing that is connectable to a frame in a number of different configurations to oscillate through various paths.

2. Prior Art

Simple swings have been used for many years and are particularly enjoyed by children of all ages. More complicated swings having more than the conventional two suspension lines have also been used by adults as, for example, the traditional "porch swing".

Swings which are capable of relatively intricate maneuvers and oscillations are also known in the prior art. For example, Williams U.S. Pat. No. 2,325,456 describes a swing which comprises a horizontal bar suspended at spaced apart ends by an outwardly disposed chain. The bar is swingable both endwise and sideways to produce a combination of upward and sideways twists similar to the movement of a bucking bronco. It is common knowledge that with the urbanization and the resultant decrease in farmland, children have fewer and fewer opportunities for physical exercise, muscular development, and coordination development. Operators of children's playgrounds have also noted the scarcity of available equipment which is at the same time both safe and enjoyable for use by children.

However, no prior art swings have the flexibility and features which allows the user to be creative and develop their own uses. The need exists for a flexible swing for both home use and playground equipment that can be simply and inexpensively constructed which will furnish both younger and older children exercise, exciting play, and opportunities for physical development.

SUMMARY OF INVENTION

It is the object of the present invention to provide a novel swing for children.

Another object of the present invention is to provide a swing with multiple options and uses provided by a plurality of suspension links that can be selected by the user to oscillate through many different paths of travel.

Another object of the present invention is to provide a swing that can be operated safely without contacting structures.

Another object of the present invention is to provide a swing that may be simultaneously used by more than one person.

Another object of the present invention is to provide a swing which is simple in design, inexpensive to manufacture, rugged in construction, easy to use and efficient in operation.

Satisfaction of these objects in accordance with the spirit of this invention a multi-use swing is herein provided that is simultaneously swingable, tilting and/or rotatable and may be used by more than one person if desired. As will be understood in connection with the disclosure herein, the swing provides a seat which can be used by one or more persons to rotate, travel in a figure "eight" path, travel in a conventional to and fro oscillation as well as additional configurations.

BRIEF DESCRIPTION OF THE DRAWINGS

FIG. 1 is a perspective view of one embodiment of the swing of the present invention;

FIG. 2 is a perspective view of the seat portion of the swing of the present invention;

FIG. 3 is a perspective view of one embodiment of one of the suspension links of the swing of the present invention;

FIG. 4 is a vertical section of a portion of the attachment means for the swing of the present invention;

FIG. 5 is a bottom plan view of the suspension platform of the present invention;

FIG. 6 is a diagrammatic representation of a number of possible connections between the seat and the support platform; and FIG. 7 is a rigid yoke for connection to the ends of the seat of the present invention.

DETAILED DESCRIPTION OF THE PREFERRED EMBODIMENT

FIG. 1 illustrates one embodiment of the swing contemplated by the present invention, generally designated 10. In this embodiment, the swing includes a frame 12, a support platform 14, a base or lower plate 15 and a pair of stabilizers 16 to prevent the swing from overturning. A seat 20 is supported from the platform 14 by a plurality of suspension links 22. The frame 12 includes a ladder element 16 on at least one end. The frame includes a pair of substantially vertical more inwardly tilted posts 24 on each end and a pair of horizontal post elements 28 connected to the upper ends of the post 24. A plurality of ladder rungs 30 between the posts 24 on one end enable the user to climb up onto the top of the support platform 14 as described hereinafter. A pair of hand rails 34 or supports are provided for added safety.

In the preferred embodiment of the present invention, a slide 40 is connected on one end of the frame 12 to provide a playful exit from the platform 13. In this form of the invention, it is not be necessary to include the ladder rungs at the end which incorporate the slide because access would be had by climbing the ladder 16 at the opposite end of the frame 12.

In an alternative embodiment, the frame 12 may be connected to a conventional "swing-set" at right angles thereto.

Referring to FIG. 2, the seat 20 may take various shapes but is shown here to be generally oval or rounded in shape, being substantially longer in the longitudinal direction of the swing as mounted in FIG. 1. Preferably, the seat is made of a durable, soft, resilient fabric such as vinyl or the like which is easily and readily cleaned. The seat 20 may be formed of a top panel 42, and a bottom panel 44 46 which are sewn together at the seams 50 and filled with a semi-rigid, flexible material, like foam rubber or the like. Although the seat portion 20 may be rigid, for safety reasons flexibility is desirable. The seat 20 also includes a plurality of circumferential handles 52 to be used as holding points for the user. Referring to FIG. 4, the support platform 14 includes a plurality of eye bolts **56*a*–56*g* which are secured through apertures in the platform 14 by nuts 58 and washers 60. In the preferred embodiment, the support platform has at least seven eyes labeled 56*a*–56*g* which are laid out in the pattern as shown in the bottom plan view of FIG. 5. In the preferred embodiment, the central eye bolts 56*g* and 57 in the top and bottom supports is releasably, rotatably mounted by a lockable thrust bearing 59**.

The eye bolts 56*a–g* are connected by a varying plurality of suspension links 22 to the connection points on the seat. The suspension links 22, as shown in FIG. 3, each include a clip 64 at the top end connected by a flexible fabric-type strap or strand 66 to a connector, generally designated 70. The connector 70 is a conventional snap-on type plastic connector having a male portion 72 and a female portion 74. In use, the male portion 72 is inserted into the female portion 74 and the prong elements 76 snap outwardly through the apertures 78 in the female portion to securely lock the connector together. A female connector portion 74 is connected to the seat at positions a–h by a small strap portion 66 so it may hang free when not in use. This type of connector allows for easy changeability for configurations of the various suspension links.

In the preferred embodiment, the female portions 74 are attached by a strap portion 66 directly to the seat portion 42 such as at the points labeled a, b and c. Similarly, connector portions 74 are connected at points d, e and f on the other side of the seat (not shown) and at points g and h at the opposite end of the seat 42.

The swing has the flexibility to be used in many different combinations of suspension links 22 between the seat 20 and the supports 14 and 15. To facilitate movement of the hooks 64 between the eye-bolts 56, a plurality of access holes 60 permit access from the top. Six of the connection combinations are shown schematically in FIG. 6 wherein each pair represents the points that are connected between the eyes 56*a–g* on the support platform 14 and the connection points a through h on the seat.

The top set is arranged with six support elements 22 so that it can support four or more people for group play. In this configuration, the eyes 56*b* and 56*d* are each connected to two points a and d and c and b on the seat. The connection points a and d on the seat are connected by supports 22 to the eye 56*b* on the support platform and similarly the points c and f are connected by a support 22 to the eye 56*d*. The respective end eyes 56*a* and 56*e* are connected to the end points g and h on the seat. In this manner, several users can swing in a generally traditional fashion and significantly can be supported by the six supports 22.

The next pair going down in FIG. 6 shows an arrangement where the seat is transverse with respect to the platform 24 and the points b and e on the seat 42 are connected to the eyes 56*b* and 56*d* or 56*a* and 56*e*. In this setup, two children can use the swing as a "tilting board" or teeter totter which can pivot about the b e axis and also swing to and fro.

In a third form of the tilt board, if all of the supports 22 are connected to the center eye-ring 56*g*, the users cannot only tilt, but can rotate in a merry-go-round fashion about the central top support. In this case, the bearing 59 can be left free to permit rotation or locked to a winding and then unwinding of the seat 20.

Moving down to the next pair, four supports 22 are used to connect the eyes 56*b* and 56*d* to the four connections a, c, d and f on the seat portion 22. The center support 56G is also connected to each end of the seat at G and H. In this setup, the seat will have much less or little ability to tilt back and forth because of the stability added by the additional supports near the end connection points.

As an alternative, or fourth configuration, a rigid connection element 80 such as that shown in FIG. 7, can be connected between the central eye 56*g* and the end connection points g and h on the seat. With this additional rigid support 80, the arms 82 will engage the support 14 to prevent the swing from inadvertently traveling over the top of the support. This connection allows the seat to safely swing through a very large arc of travel.

The next configuration has six support links 22 connecting the center eye 56*g* to the points a, c, d, f, g and h on the seat. In addition, in this configuration, the points g and h are connected by two additional supports to the eye 57 on the lower base or plate 15. In this fashion, the seat will remain essentially in a single plane but can be rotated in a round table or carousel fashion and be used as an ordinary carousel.

In another variant, the seat 22 may be supported in a vertical orientation as shown in the bottommost pair between the eye 56*g* and the end connection point g for swinging and rotating simultaneously. Two or more persons can "hang on" to the handles 52 on the seat in this configuration. Alternatively, the bottom point f on the seat can be connected to the lower eye 57 to reduce the to and fro swinging action while permitting rotation.

Obviously, with the present structure as described and with simple modifications or additional connection points provided to the seat and the upper and lower supports, many different types of motion can be generated and therefore no unnecessary limitations should be understood from the foregoing description as many modifications will be obvious to those skilled in the art.

I claim:

1. A flexible swing includes a support frame;
a seat for one or more users;
a plurality of support links;
a plurality of connecting means for connecting the support links to the frame; and
a plurality of connection means on the seat for connection to the support links whereby a plurality of combinations of one or more suspension links between the frame and the seat provide for a large number of configurations and uses of the swing whereby the seat will travel in different paths.

2. The flexible swing of claim 1 wherein the suspension links are flexible.

3. The flexible swing of claim 2 wherein at least one of the suspension links is rigid.

4. The flexible swing of claim 1 wherein one end of each suspension link and the connection means on the seat comprises a quick release means to facilitate easy reconfiguration of the swing assembly.

5. The flexible swing of claim 4 wherein at least one of the connection means on the frame is rotatably mounted on the frame.

6. The flexible swing of claim 5 wherein said rotatable connection means is lockable in a predetermined position.

7. The flexible swing of claim 6 including two rotatable connection means on the frame.

8. A multi-use swing apparatus includes a rigid support frame having a top and bottom support means;
an elongated seat portion for multiple users;
a plurality of support means for connecting the seat portion to the frame for relative movement;
a plurality of first connecting means for connecting the support means to the frame; and a plurality of second connection means on the seat for connection to the support means whereby a plurality of combinations of one or more suspension means between the frame and the seat portion provide a large number of uses of the swing whereby the seat will travel in different paths.

9. The multi-use swing apparatus of claim 8 wherein the suspension means are flexible links.

10. The multi-use swing apparatus of claim 8 wherein at least one of the suspension means is rigid.

11. The multi-use swing apparatus of claim 8 wherein second connection means on the seat comprises a quick release means to facilitate easy reconfiguration of the swing apparatus.

12. The multi-use swing apparatus of claim 11 wherein at least one of the first connection means on the frame is rotatably mounted on the frame.

13. The multi-use swing apparatus of claim 12 wherein said rotatable connection means is lockable in a predetermined position.

14. The multi-use swing apparatus of claim 13 including two rotatable connection means on the frame.

15. A multi-use swing includes a stabilized support frame, a seat for one or more users, a plurality of support links each having a first and second end, a plurality of connectors on the first end of said support limbs for connecting the support links to the frame; and a plurality of quick release connectors for connecting the second end of the support links to the seat whereby a plurality of combinations of one or more suspension links between the frame and the seat provide for a large number of configurations and uses of the swing whereby the seat will travel in different paths.

16. The multi-use swing of claim 15 wherein the suspension means are flexible links.

17. The multi-use swing of claim 15 wherein at least one of the suspension means is rigid.

18. The multi-use swing of claim 15 wherein the quick release connectors each include a receptor on the seat for connection with a clip on the second ends of the support links which securely connect the support link to the seat while permitting easy disconnection to facilitate easy reconfiguration of the swing assembly.

19. The multi-use swing of claim 15 wherein at least one of the connectors on the frame is rotatably mounted on the frame.

20. The multi-use swing of claim 19 wherein said rotatable connector is lockable in a predetermined position.

21. The multi-use swing of claim 20 including two rotatable connectors on the frame.

* * * * *